US010280606B1

(12) United States Patent
Smith

(10) Patent No.: US 10,280,606 B1
(45) Date of Patent: May 7, 2019

(54) NON-LEAKING TOILET

(71) Applicant: Sam Barry Smith, Spring Hill, FL (US)

(72) Inventor: Sam Barry Smith, Spring Hill, FL (US)

( * ) Notice: Subject to any disclaimer, the term of this patent is extended or adjusted under 35 U.S.C. 154(b) by 0 days.

(21) Appl. No.: 15/984,979

(22) Filed: May 21, 2018

(51) Int. Cl.
*E03D 11/17* (2006.01)
*E03D 11/16* (2006.01)
*E03D 11/13* (2006.01)

(52) U.S. Cl.
CPC ..... *E03D 11/16* (2013.01); *E03D 11/135* (2013.01); *E03D 11/17* (2013.01)

(58) Field of Classification Search
CPC ..... E03D 11/16; E03D 11/17; E03D 11/135
USPC ..... 4/252.4, 252.5
See application file for complete search history.

(56) References Cited

U.S. PATENT DOCUMENTS 3,568,222 A * 3/1971 Gantzert ..... E03D 11/16 4/252.5
3,821,820 A * 7/1974 Thompson ..... E03D 11/16 4/252.6
6,052,839 A * 4/2000 Teskey ..... E03D 11/16 4/252.4
6,719,294 B2 * 4/2004 Nguyen ..... E03D 11/16 277/314
9,758,957 B2 * 9/2017 Schuster ..... E03D 11/17
2001/0023505 A1 * 9/2001 Atkins ..... E03D 11/16 4/252.6
2002/0166161 A1 * 11/2002 Carwile ..... E03D 11/16 4/252.6
2005/0278841 A1 * 12/2005 Coronado ..... E03D 11/16 4/252.5
2007/0011799 A1 * 1/2007 Brooks ..... E03D 11/16 4/252.1
2008/0148469 A1 * 6/2008 Dipzinski ..... E03D 11/16 4/252.5

* cited by examiner

*Primary Examiner* — Huyen D Le
(74) *Attorney, Agent, or Firm* — Michele L. Lawson; Smith & Hopen, P.A.

(57) ABSTRACT

A non-leaking toilet and retrofit base drain outlet extension apparatus for existing toilets that eliminates the use of wax rings is presented. Extension apparatus fluidly connects to existing drain outlet on a toilet to extend drain outlet further into flange thus preventing leaks. A new toilet can be manufactured with extension apparatus already connected to drain outlet or extension apparatus can be connected to an existing toilet. Extension apparatus can be angled for use in offset flange or can be straight for use in straight flange.

13 Claims, 6 Drawing Sheets

NON-LEAKING TOILET

FIELD OF THE INVENTION

This invention relates to a novel toilet. More particularly, it relates to a non-leaking toilet as well as a retrofit base drain outlet extension apparatus for existing toilets that will eliminate the use of wax rings.

BACKGROUND OF THE INVENTION

One of the problems facing homeowners today relates to toilet leaking onto the floor or subfloor of a bathroom. Currently, wax seals or rubber gaskets are used to seal the area between the floor flange and the base of a toilet to prevent leaking from the base of a flush toilet. Unfortunately, such devices are known to wear out over time producing breaks and cracks within the gasket at which point leaking can occur. Even small leaks can cause damage to the floor/subfloor which can amount to a substantial cost to repair.

As illustrated above, the prior art has several disadvantages when it comes to preventing leaking from a toilet base. Accordingly, what is needed is a new way to ensure that a toilet will not leak from the base.

SUMMARY OF INVENTION

The inventors have developed a new non-leaking toilet having a component which can be retrofitted onto an existing toilet to make it non-leaking. Essentially an extension apparatus having the same diameter as the drain outlet on an existing toilet is attached to the drain outlet. This extension apparatus is inserted into the toilet flange in the floor so as to extend a substantially longer distance into the flange as compared to the traditional ½ inch the drain outlet on an existing toilet extends. This extension apparatus prevents water from leaking from the base of the toilet and eliminates the use of wax seals and gaskets which can become compromised over time thus leading to them being replaced, which is an unsanitary and time consuming process.

In an embodiment, an apparatus for preventing leaks from base of a toilet is presented comprising: an extension apparatus attached to a drain outlet at bottom of the base of the toilet. The extension apparatus can extend at least one inch into a flange defining an interior diameter positioned in a subfloor. The extension apparatus may have a diameter equal to diameter of the drain outlet with the interior diameter of the flange being larger than exterior diameter of the extension apparatus so that the extension apparatus can extend fully into the interior diameter of the flange. In some embodiments, the extension apparatus is fixedly attached to the drain outlet. The extension apparatus may be between about 1 inch to about 5 inches in height and extend at least 2 inches into the flange.

In some embodiments, an annular seal may be positioned around the extension apparatus where it attaches to the drain outlet.

In embodiments in which a straight flange is used, the extension apparatus is configured in a straight line. In embodiments in which an offset flange is used, the extension apparatus is configured at an angle equal to the angle of the offset flange.

In a further embodiment, a non-leaking toilet is presented comprising: a toilet bowl; a toilet base supporting the toilet bowl; a drain outlet positioned at bottom of the toilet base; and an extension apparatus attached to the drain outlet at the bottom of the toilet base. The extension apparatus can extend at least one inch into a flange defining an interior diameter positioned in a subfloor. The extension apparatus may have a diameter equal to diameter of the drain outlet with the interior diameter of the flange being larger than exterior diameter of the extension apparatus so that the extension apparatus can extend fully into the interior diameter of the flange. In some embodiments, the extension apparatus is fixedly attached to the drain outlet. The extension apparatus may be between about 1 inch to about 5 inches in height and extend at least 2 inches into the flange.

In some embodiments, an annular seal may be positioned around the extension apparatus where it attaches to the drain outlet.

In embodiments in which a straight flange is used, the extension apparatus is configured in a straight line. In embodiments in which an offset flange is used, the extension apparatus is configured at an angle equal to the angle of the offset flange.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
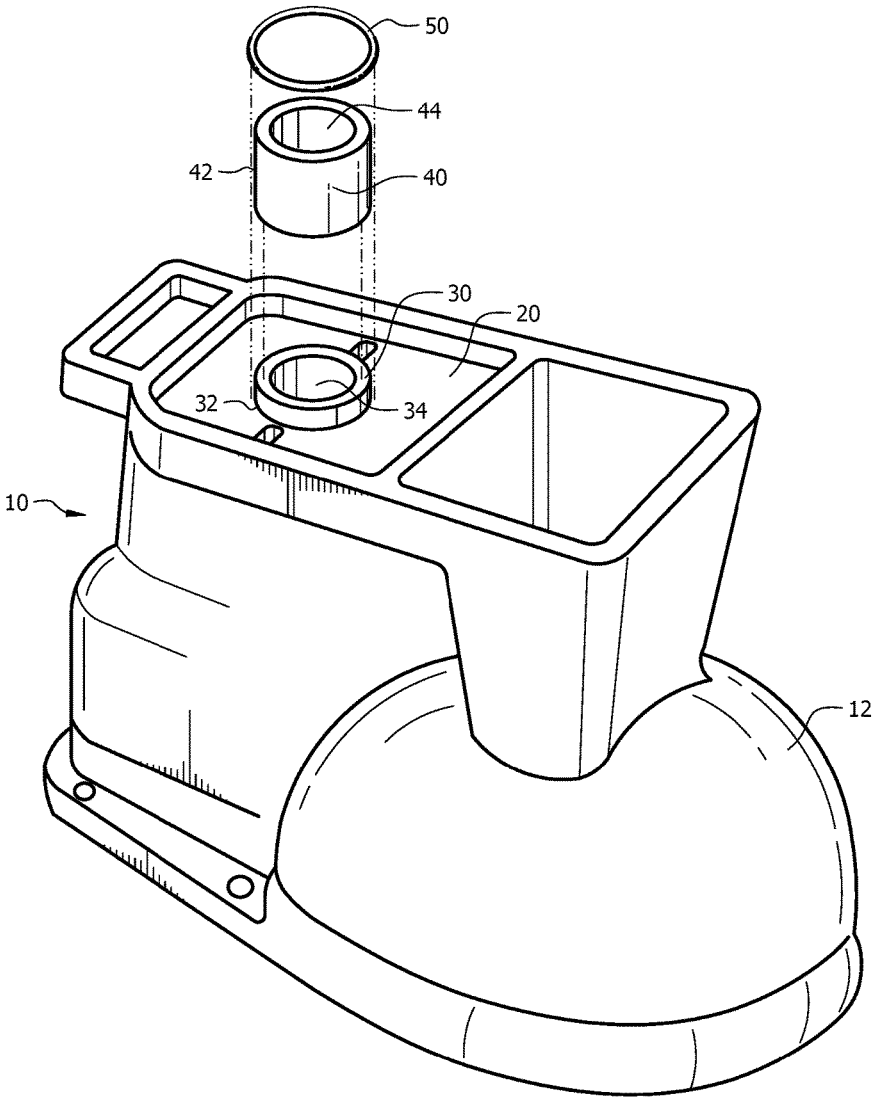
FIG. 1 is a perspective view of the bottom of an existing toilet base being retrofitted with the new extension apparatus.

In the following detailed description of the preferred embodiments, reference is made to the accompanying drawings, which form a part hereof, and within which are shown by way of illustration specific embodiments by which the invention may be practiced. It is to be understood that there are other embodiments by which the invention may be practiced. It is to be understood that other embodiments may be utilized and structural changes may be made without departing from the scope of the invention.

Definitions

As used in the specification and claims, the singular form "a", "an" and "the" include plural references unless the context clearly dictates otherwise.

Measurements and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include the individual values and sub-ranges within the indicated range. Thus, included in this numerical range are individual values such as 2, 3, and 4 and sub-ranges such as from 1-3, from 2-4 and from 3-5, etc. This same principle applies to ranges reciting only one numerical value. Furthermore, such an interpretation should apply regardless of the range or the characteristics being described.

Where a range of values is provided, it is understood that each intervening value, to the tenth of the unit of the lower limit, unless the context clearly dictates otherwise, between the upper and lower limits of that range is also specifically disclosed. Each smaller range between any stated value or intervening value in a stated range and any other stated or intervening value in that stated range is encompassed in the invention. The upper and lower limits of these smaller ranges may independently be excluded or included within the range. Each range where either, neither, or both limits are included in the smaller ranges are also encompassed by the invention, subject to any specifically excluded limit in the stated range. Where the stated range includes one or both of the limits, ranges excluding either or both of those excluded limits are also included in the invention.

The term "about" or "approximately" as used herein refers to being within an acceptable error range for the particular value as determined by one of ordinary skill in the art, which will depend in part on how the value is measured or determined, i.e. the limitations of the measurement system, i.e. the degree of precision required for a particular purpose. As used herein, "about" refers to ±10%.

"Extension apparatus" as used herein refers to an elongated tube, being open at both ends, that may be fixedly attached to the drain outlet of the base of an existing toilet. In new manufacture of toilets, the toilet would be manufactured with the extension apparatus already being fixedly attached to the base of the toilet. Extension apparatus can be in a straight or angular configuration with the former being used with straight flanges and the latter being used with offset flanges. If an angular configuration is used, the angle of the extension apparatus is the same as the angle of the offset flange so as to follow the angle of the offset flange when inserted into the offset flange.

"Drain outlet" as used herein refers to the orifice in the base of a toilet through which wastewater from the toilet bowl flows when the toilet is flushed. On most modern Western flush toilets, drain outlet extends downward from base of toilet about ½ inch. Drain outlet fits within the flange when the toilet is seated on the floor.

"Flange" as used herein refers to a pipe fitting having a flat collar or ring at the end of the pipe to mount a toilet to the floor and to connect the drain outlet of the toilet to the sewer drain pipe. The flange is attached to the floor or subfloor and the base of a toilet is subsequently attached to the flange by a pair of bolts. As used herein, the term "flange" is said to encompass both straight toilet flanges as well as offset flanges. An "offset flange" is a flange in which the corresponding pipe is angled in a given direction as opposed to extending in a straight line as in a straight toilet flange. "Flange", "closet flange" and "toilet flange" are used synonymously herein.

"Annular seal" as used herein refers to a thin circular ring which may be used to provide a seal between the extension apparatus and the flange. In some embodiments, the annular seal is a rubber O-ring. The annular seal is not a wax ring or thick gasket as is being currently used on toilets.

"Sewer drain pipe" or "drain pipe" as used herein refers to a pipe used to direct the flow of wastewater away from the toilet. The sewer drain pipe is attached to the opposite end of the pipe from the flange to provide a continuous channel for the drainage of wastewater.

"Toilet" as used herein refers to a conventional Western flush toilet having a tank, bowl and drain outlet in the toilet base.

"Subfloor" as used herein refers to the rough floor layer which serves as the base layer for the "finished" floor. The subfloor is commonly plywood, OSB or concrete. The finished floor, such as tile, carpet, laminate, hardwood, etc. is laid on the subfloor, sometimes with an underlayment positioned between.

"Floor" as used herein refers to the finished layer that is laid on top of the subfloor. The finished floor can be tile, carpet, laminate, hardwood, etc. "Floor" and "finished floor" are used interchangeably herein.

"Height" as used herein refers to the vertical distance from one end of an object to the other. As used herein, height of the extension apparatus or flange is measured from one open end to the other open end, for example from top to bottom when oriented vertically.

"Interior" as used herein refers to the inner surface positioned closer to the center within a cylindrical object which is in contact with a substance flowing through it. Interior diameter is measured in a straight line from side to side (inner surface to inner surface) through the center of the cylindrical object. In cases where only "diameter" is used, without "interior", the measurement is defined as being an exterior measurement (from outer surface to outer surface).

"Exterior" as used herein refers to the outside surface of a cylindrical object giving the object structure. Exterior diameter is measured in a straight line from side to side (outer surface to outer surface) through the center of the cylindrical object.

Leaky toilets have been a problem for many homeowners. In most cases, toilets leak from the base due to a worn out, cracked or broken seal between the flange and the drain outlet at the base of the toilet. The instant invention solves the problem of toilets leaking from the base by replacing existing wax seals and gaskets with an extension apparatus that attaches to the drain outlet and extends into the flange at least twice the distance of an existing drain outlet.

Current drain outlets extend ½ inch from the bottom of the base of the toilet. This ½ inch is inserted into the flange and a wax seal or gasket is positioned around the drain outlet and between the bottom of the base of the toilet and the flange. Once the seal is compromised, water can escape from the base of the toilet thus damaging the floor and/or subfloor.

In the instant invention, the additional extension of the drain outlet into the flange directs the water through the flange with no chance of leaking. The extension apparatus is positioned within the flange so as to leave very little room between the exterior wall of the extension apparatus and the interior wall of the flange thus further preventing water from seeping onto the floor.

FIG. 1 depicts an existing toilet 10 in an inverted configuration so that the bottom of base of toilet is viewable. A standard Western flush toilet is depicted with tank, bowl 12, toilet base 20 and drain outlet 30 shown in the figure. As shown in the figure, drain outlet 30 is positioned at bottom of base 20 of toilet with drain outlet 30 protruding from base ½ inch. Extension apparatus 40 is shown as capable of being attached to drain outlet 30. Extension apparatus 40 can be fixedly attached to drain outlet 30 by any means known in the art, depending on the material of the extension apparatus, including, but not limited to, waterproof glue or epoxy, solvent cement, transition coupling, and rubber or metal couplings.

Extension apparatus 40 has a diameter, both the exterior diameter from outer wall (surface) 42 to outer wall (surface) 42 as well the interior diameter from inner wall (surface) 44 to inner wall (surface) 44, that is the same as that of drain outlet 30 which allows extension apparatus 40 to be affixed directly to drain outlet 30 without losing any size in diameter.

Figure 2:
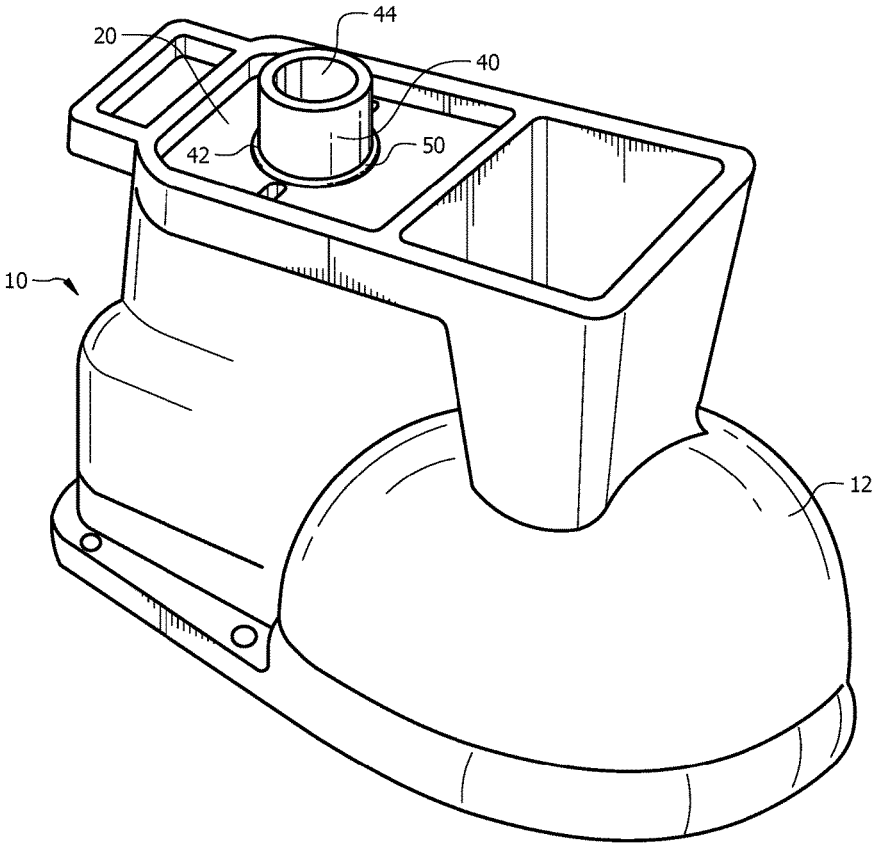
FIG. 2 is a perspective view of a new toilet having the extension apparatus attached. This view is also applicable to the existing toilet of FIG. 1 with the retrofit extension apparatus attached.

FIG. 2 depicts, alternatively, existing toilet 10 with extension apparatus 40 attached to drain outlet 40 or new toilet manufactured with extension apparatus 40 already attached. Optional annular seal 50 is shown as encircling extension apparatus 40. When extension apparatus 40 is attached to drain outlet 30, annular seal 50 abuts bottom of toilet base 20, encircling drain outlet 30.

Similarly, in new toilet manufactured with extension apparatus 40, annular seal 50 abuts bottom of toilet base 20. Annular seal 50 is used as a further safeguard to preventing leaks. It is noteworthy that annular seal 50 is not a wax ring or gasket as is currently used with toilets. Rather, annular seal 50 can be a thin O-ring or other type of circular seal known in the art.

Extension apparatus 40 can be made of any solid waterproof material including, but not limited to, porcelain, ceramic, clay, metal, concrete, and plastic such as PVC or ABS. In embodiments where the new toilet is manufactured with extension apparatus 40 attached, extension apparatus is preferably manufactured from the same material as the toilet, which in most cases is porcelain.

Figure 3:
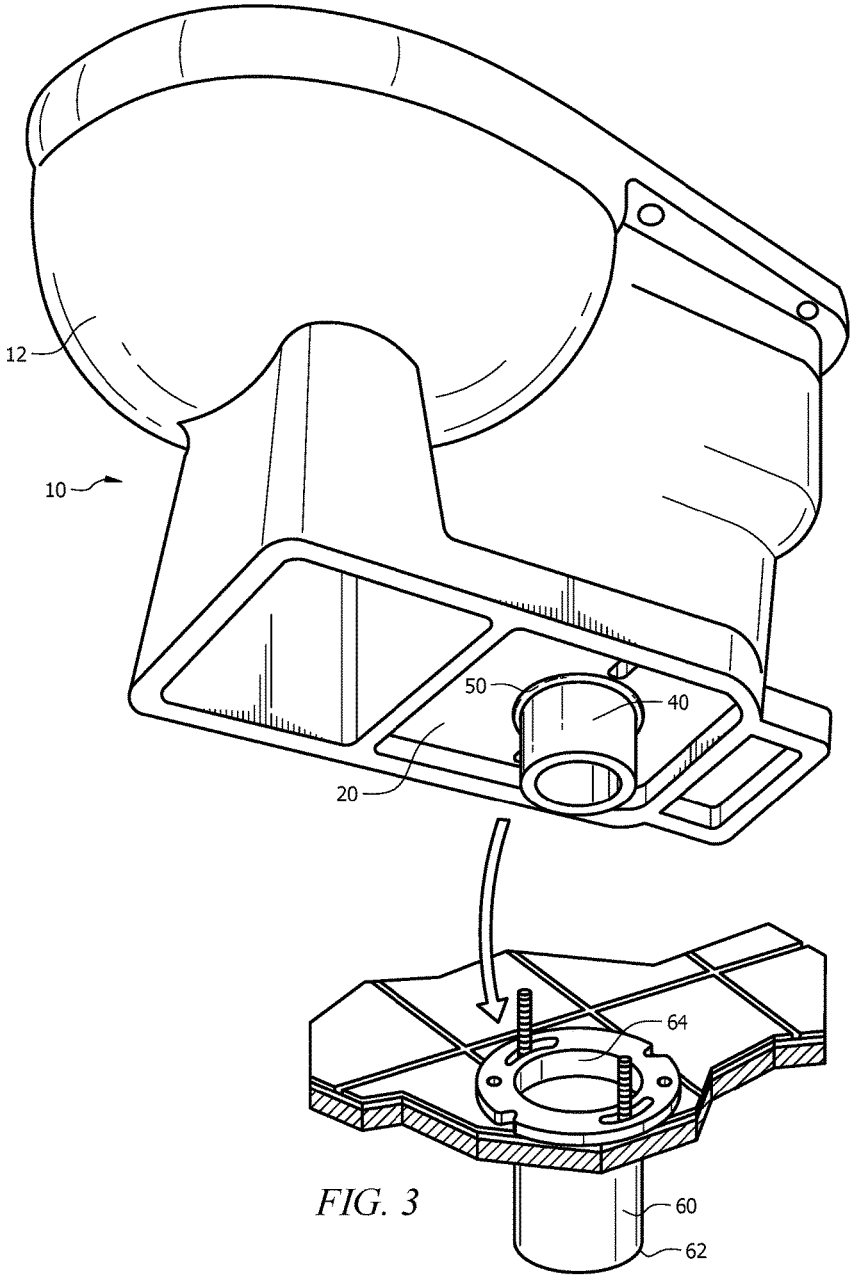
FIG. 3 is a perspective view of the new toilet/existing toilet with extension apparatus being positioned within the flange located in the floor.

FIG. 3 depicts positioning of toilet 10 having a straight extension apparatus 40 within straight flange 60 which leads to sewer pipe 90. Extension apparatus 40 is positioned to fit fully within interior diameter of flange 60. Once seated, bolts are used to attach toilet 10 to flange 60.

In use as a retrofit for an existing toilet, extension apparatus 40 (and angled extension apparatus 70) can be between about ½ inch to about 5 inches in height. The height of extension apparatus 40 (and angled extension apparatus 70) is limited by the height of flange 60. Most toilet flanges, both straight flanges and offset flanges, are between about 6 to 8 inches in height, with the most common height being 7 inches. Extension apparatus 40 (and angled extension apparatus 70) cannot have a height exceeding flange 60 height and must leave sufficient space for flange 60 or offset flange 80 to connect to sewer drain pipe 90. In use with a newly manufactured toilet, extension apparatus 40 (and angled extension apparatus 70) can be between about 1 inch to about 5 inches in height. The difference in the minimum height measurement between the retrofit and new manufacture is due to the ½ inch drain outlet 30 currently on existing toilets.

Diameter of extension apparatus 40 (and angled extension apparatus 70) from exterior wall 42 (72) to exterior wall 42 (72) must be less than the interior diameter of flange 60 so as to be able to be positioned within flange 60 or offset flange 80, respectively. Most existing toilet flanges, including straight and offset flanges, have an interior diameter (as measured from interior wall to interior wall) of between about 3 to 4 inches, with most commercially available flanges having an interior diameter of about 4 inches. As such, diameter of extension apparatus 40 (and angled extension apparatus 70) from exterior wall 42 (72) to exterior wall 42 (72) must be less than 4 inches in the event a 4 inch diameter flange is used and must be less than 3 inches in the event a 3 inch diameter flange is used. Extension apparatus 40 (and angled extension apparatus 70) fits snugly within flange 60 or offset flange 80, respectively, the same as drain outlet 30 would fit into flange 60 in an existing toilet configuration, leaving very little space between inner wall 64 of flange 60 and exterior wall 42 (72) of extension apparatus 40 (and angled extension apparatus 70). In some embodiments, exterior wall 42 (72) of extension apparatus 40 (and angled extension apparatus 70) abuts inner wall 64 (84) of flange 60 or offset flange 80. In other embodiments, the space between inner wall 64 (84) of flange 60, and offset flange 80, and exterior wall 42 (72) of extension apparatus 40 (and angled extension apparatus 70) is ⅛ inch or less.

Figure 4:
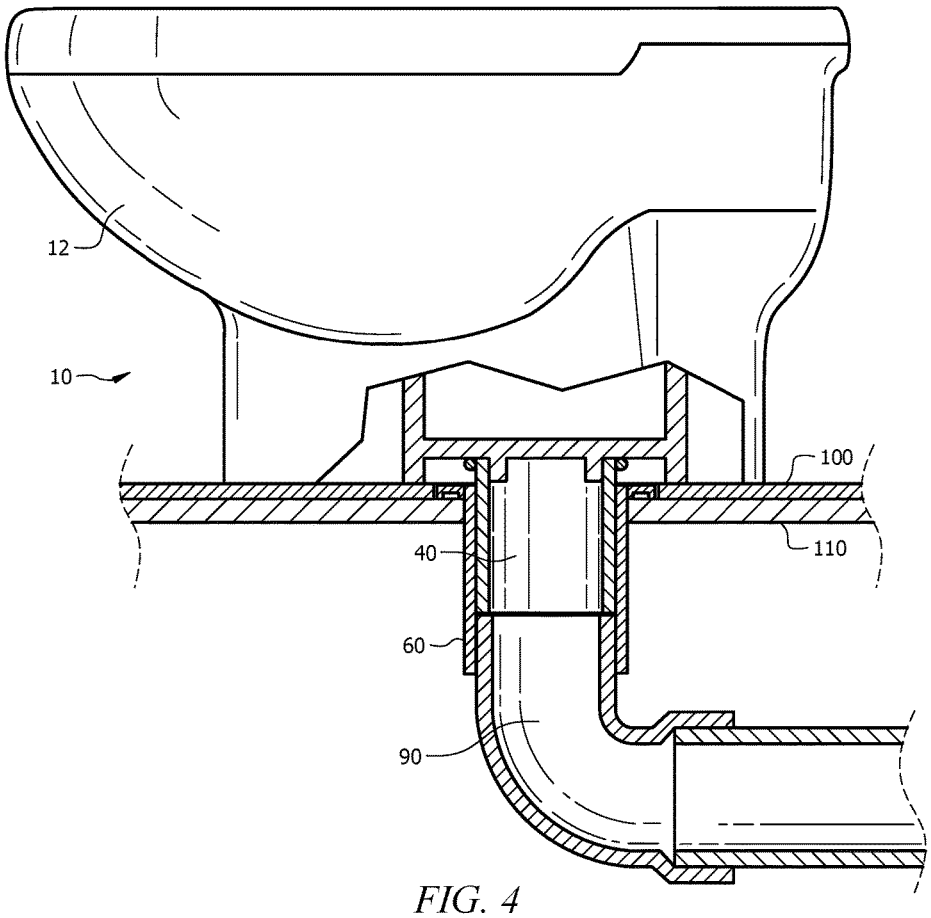
FIG. 4 is a side cross-sectional view of the new toilet/existing toilet with extension apparatus positioned within the flange in the floor and ready for use.

FIG. 4 depicts a side cross-sectional view showing extension apparatus 40 seated within inner diameter of flange 60. Toilet 10 is shown as abutting floor 100, such as tile with flange 60 positioned so as to abut subfloor 110. In some cases, flange 60 may abut floor 100 as opposed to subfloor 110. As shown in the figure, extension apparatus 40 fits snugly within interior diameter of flange 60, with very little empty space around the circumference of extension apparatus 40. Extension apparatus 40 is shown as extending into flange 60 over half way the height of flange 60. Extension apparatus 40 can extend into flange 60 several inches as long as it does not extend past second end (bottom) of flange 60 where it connects to sewer drain pipe 90. Flange 60 must be able to be connected to sewer drain pipe 90 to flow wastewater from toilet 10 into sewer system.

Figure 5:
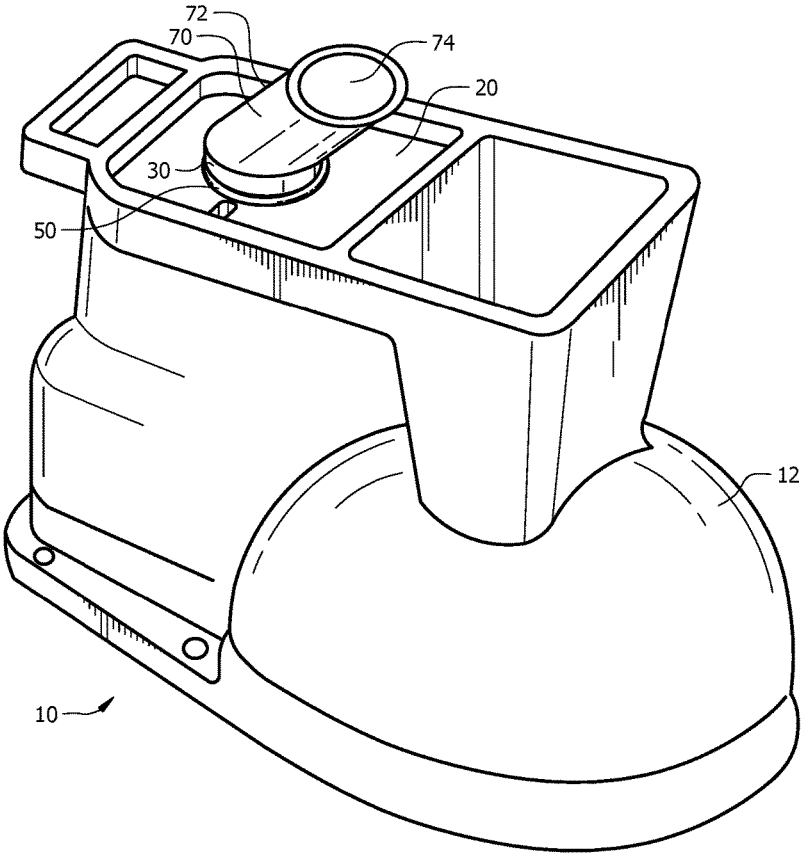
FIG. 5 is a perspective view of the base of an existing toilet with an angular extension apparatus for use in an offset flange attached.

FIG. 5 depicts a perspective view of an alternative embodiment in which extension apparatus 70 is configured at an angle for use in an offset flange 80. As depicted in the figure, angled extension apparatus 70 is connected to drain outlet 30 on an opposing open end. Angled extension apparatus 70 can be fixedly attached as described previously with regard to straight extension apparatus 40, or alternatively, may be rotatably attached so as to be used with offset flange 80 regardless of the orientation of offset flange 80 in floor 100. If rotatably attached, once orientation is determined, extension apparatus 70 may be fixedly attached via coupling, locking mechanism or other means to maintain the correct orientation for insertion into offset flange 80.

Figure 6:
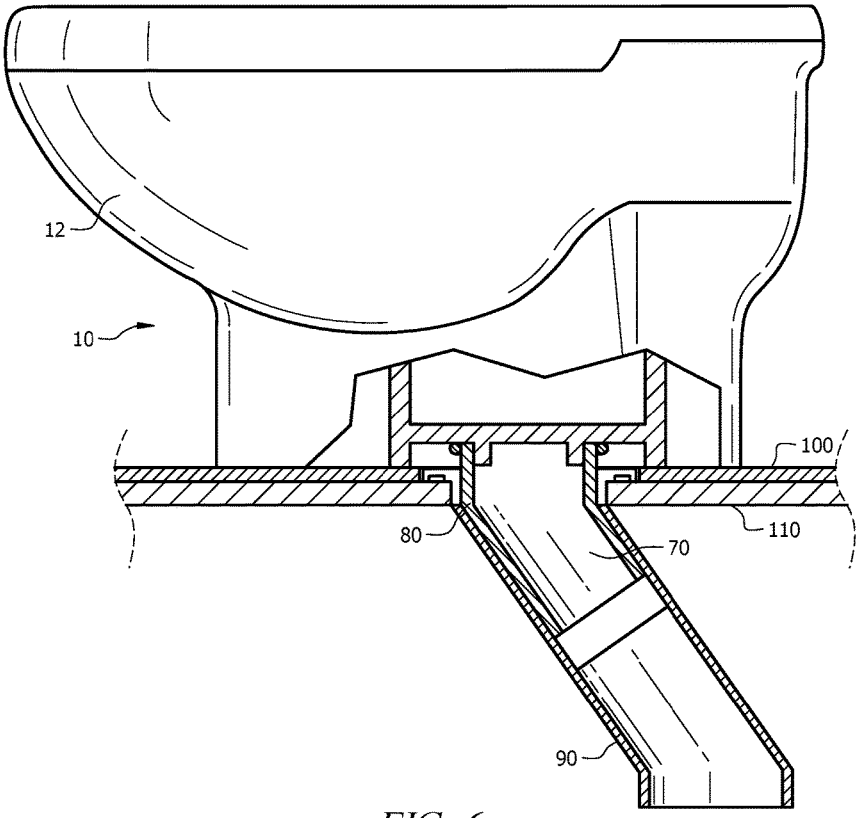
FIG. 6 is a side cross-sectional view of the toilet having the angular extension apparatus for use in an offset flange positioned within the offset flange and ready for use.

FIG. 6 is a side cross-sectional view of angled extension apparatus 70 within offset flange 80. Angled extension apparatus 70 in this view has been fixedly attached to drain outlet 30 in the orientation of the angle of offset flange 80. As in FIG. 4, toilet 10 is shown abutting floor 100 with offset flange 80 anchored to subfloor 110 and positioned beneath drain outlet 30 in toilet 10. Angled extension apparatus 70 is inserted into offset flange 80 to the point where toilet base 20 sits on top of floor 100. At this point, bolts can be used to fasten toilet 10 to floor 100 and offset flange 80. Angled extension apparatus 70 fits snugly within interior diameter of offset flange 80, leaving very little space between exterior wall 72 of angled extension apparatus 70 and interior wall 84 of offset flange 80.

In use with a newly manufactured toilet, drain outlet 30 of toilet 10 would be manufactured as is currently done with existing toilets and then angled extension apparatus 70 would be continuously formed from opposing end of drain outlet 30 (similar to positioning of the retrofit angled extension apparatus on drain outlet). With a newly manufactured toilet, if a rotatable connection is required, angled extension apparatus 70 would be rotatable at toilet base 20 where drain outlet 30 protrudes from toilet base 20. As described above, once correct orientation of angled extension apparatus 70 is obtained, angled extension apparatus 70 can be fixedly attached.

Conclusion

In conclusion, the instant invention overcomes the deficiencies of the prior art and allows for both the construction of new toilets having the extension apparatus as well as retrofitting existing toilets with the extension apparatus to prevent leaking from the base of the toilet without the use of wax rings or gaskets. As such, the instant invention is more sanitary, convenient and cost effective as there is no removing of the toilet to replace the wax ring or gasket.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween. Now that the invention has been described,

What is claimed is:

1. An apparatus for preventing leaks from base of a toilet comprising:

an extension apparatus having a diameter equal to diameter of a drain outlet and attached to the drain outlet at bottom of the base of the toilet wherein when attached to the drain outlet, the extension apparatus and the drain outlet form a continuous tube having the same diameter along length of the tube for direct insertion into a flange;

wherein the extension apparatus extends at least one inch directly into the flange defining an interior diameter positioned in a subfloor;

wherein interior diameter of the flange is larger than exterior diameter of the extension apparatus so that the extension apparatus can extend fully into the interior diameter of the flange;

wherein extension apparatus height does not exceed height of flange so as to not contact interior diameter of sewer pipe.

2. The apparatus of claim 1, wherein the extension apparatus is between about 1 inch to about 5 inches in height.

3. The apparatus of claim 1, wherein the extension apparatus is fixedly attached to the drain outlet.

4. The apparatus of claim 1, wherein the extension apparatus extends at least two inches into the flange.

5. The apparatus of claim 1, wherein the flange is a straight flange.

6. The apparatus of claim 5, wherein the extension apparatus is configured in a straight line.

7. The apparatus of claim 1, wherein the flange is an offset flange.

8. The apparatus of claim 7, wherein the extension apparatus is configured at an angle equal to an angle of the offset flange.

9. A non-leaking toilet comprising:

a toilet bowl;

a toilet base supporting the toilet bowl; and an extended drain outlet integrally formed with bottom of the toilet base and having a same diameter along length of the extended drain outlet wherein the drain outlet is between about 1 inch to about 5 inches in height for direct insertion into a flange and extends into a flange defining an interior diameter, positioned in a subfloor;

wherein the interior diameter of the flange is larger than the exterior diameter of the drain outlet so that the drain outlet can fit within the interior diameter of the flange;

wherein drain outlet height does not exceed height of flange so as to not contact interior diameter of sewer pipe.

10. The non-leaking toilet of claim 9, wherein the flange is a straight flange.

11. The non-leaking toilet of claim 10, wherein the drain outlet is configured in a straight line.

12. The non-leaking toilet of claim 9, wherein the flange is an offset flange.

13. The non-leaking toilet of claim 12, wherein the drain outlet is configured at an angle equal to an angle of the offset flange.

* * * * *